United States Patent [19]

Ludwig

[11] Patent Number: 4,768,844

[45] Date of Patent: Sep. 6, 1988

[54] OFFICE CABINET

[75] Inventor: Gary R. Ludwig, Kitchner, Canada

[73] Assignee: Hauserman, Inc., Cleveland, Ohio

[21] Appl. No.: 47,269

[22] Filed: May 8, 1987

[51] Int. Cl.[4] ..... E05C 7/06

[52] U.S. Cl. ..... 312/221; 312/219

[58] Field of Search ..... 312/316–321, 312/311, 322, 323

[56] References Cited

U.S. PATENT DOCUMENTS

| | | | |
|---|---|---|---|
| 896,028 | 8/1908 | Leese | 312/219 |
| 2,240,067 | 4/1941 | Bolesky et al. | 312/218 X |
| 2,853,355 | 9/1958 | Paca et al. | 312/323 X |
| 3,870,387 | 3/1975 | Mortashed | 312/219 X |
| 3,888,558 | 6/1975 | Himsl | 312/221 X |
| 3,900,236 | 8/1975 | Goulish et al. | 312/217 |
| 3,909,090 | 9/1975 | Breckner et al. | 312/217 |
| 3,941,441 | 3/1976 | Scheerhorn | 312/218 X |
| 4,298,236 | 11/1981 | Laroche | 312/221 X |
| 4,303,287 | 12/1981 | Taplin | 312/217 X |
| 4,355,851 | 10/1982 | Slusser | 312/221 X |
| 4,425,013 | 1/1984 | Killen | 312/221 X |
| 4,429,930 | 2/1984 | Blouin | 312/221 X |
| 4,480,883 | 11/1985 | Young | 312/220 |

*Primary Examiner*—Joseph Falk

*Attorney, Agent, or Firm*—Renner, Otto, Boisselle & Sklar

[57] ABSTRACT

A locking system for a filing cabinet which permits only one drawer to be pulled out at a time includes a vertical track at the side of the cabinet in which move vertically extending bars, one for each drawer, against the pressure of a spring through a predetermined limited distance. When the cabinet is locked the bars are held against any movement. When the cabinet is unlocked, such movement is permitted. When one drawer is withdrawn, a two position cam on the respective bar is rotated 90°. The cam is rotationally mounted on one bar but bears against a projecting shelf on the next adjacent bar or a fixed shelf. When the cam is rotated by the respective drawer being pulled out further movement of the bars is precluded locking all of the other drawers against withdrawal. Each cam includes a projection adapted to be engaged by a lateral pin on the drawer as it is withdrawn and a hook which is positioned to catch the drawer pin when the drawer is replaced in the cabinet to return the cam to its original position. The cam may include a second hook for engaging and releasing a flip-up door for each cabinet drawer. The spring may be positioned at the top or the bottom of the track with the limited movement of the bars being either up or down. The invention may be used with a full height cabinet or a shorter credenza or pedestal type cabinet.

16 Claims, 7 Drawing Sheets

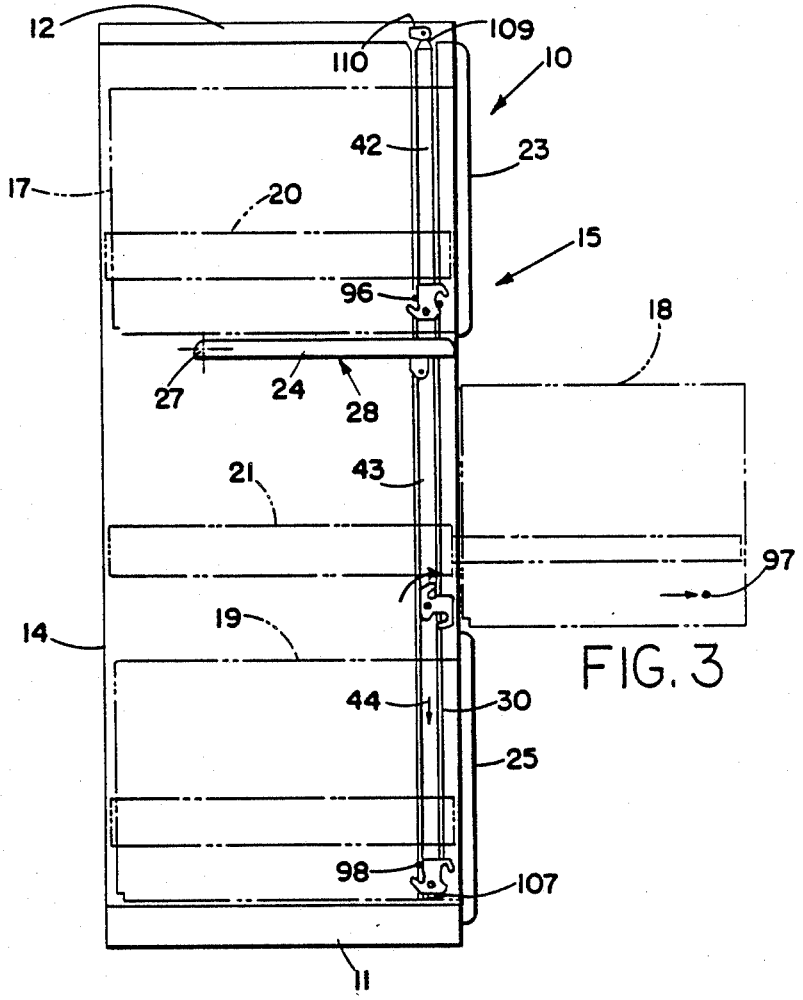
FIG. 3
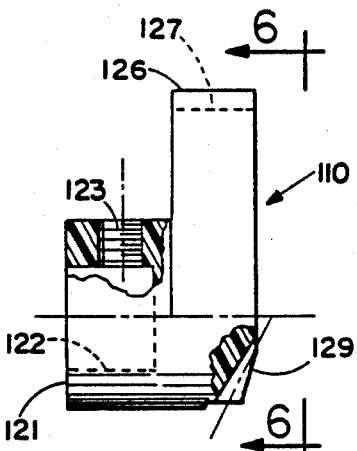
FIG. 5
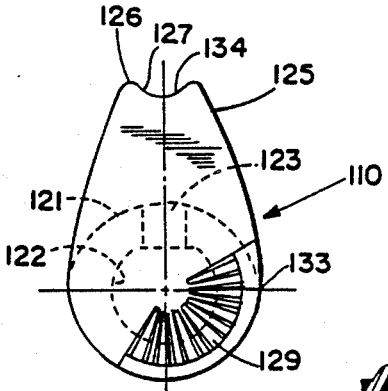
FIG. 6
FIG. 7
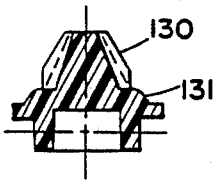

OFFICE CABINET

DISCLOSURE

This invention relates generally as indicated to an office cabinet and more particularly an office filing cabinet having a lock and interlock system for locking the cabinet and when open permitting only one drawer to be pulled from the cabinet at a time.

BACKGROUND OF THE INVENTION

In filing cabinets, it is desirable that cabinets can be locked for security reasons, and when unlocked, that only one of the drawers can be pulled out at a time. That is, when one drawer is pulled out even partially, the other drawers should be locked against withdrawal, otherwise, costly and awkward excessive counterweights are required.

A wide variety of fairly complex interlock mechanisms have been proposed to accomplish both the security aspects of filing cabinets and to limit the opening of drawers to but one at a time. Examples of such prior art devices may be seen in the following U.S. Pat. Nos. 4,480,883; 4,429,930; 4,298,236; 3,900,236; 3,909,090; 3,888,558; 3,941,441; 4,355,851; 3,870,387; 4,425,013; 4,303,287; 3,404,929; and 2,240,067.

Because of the complexity of interlock mechanisms they are both costly and subject to failure. They can also be noisy. There is nothing more frustrating than a file drawer which won't open, or one which, when open, won't close properly, or when properly closed won't lock. Thus it is desirable to have a system of few parts with limited movement, and which can readily be replaced when broken or worn.

SUMMARY OF THE INVENTION

A lock and interlock system for cabinets, either of the full height drawer type or of the shorter pedestal type utilizes in the cabinet side wall a track in which are vertically movable bars, there being one bar for each drawer. Such bars are mounted for movement a short limited vertical distance against a compression spring which may be either at the top or bottom of the track.

Each bar is provided with a two position locking cam which is designed to oscillate 90°. The locking cam includes two bearing surfaces 90° apart which may bear against a shelf projecting from the next adjacent locking bar, or a fixed shelf as in the case of the bottom bar. The displacement difference between the two bearing surfaces is the limited short distance movement the bars may move against the compression of the spring. The cam surface between the two bearing surfaces is ramped and then somewaht sharply cornered so that the cam won't remain in a position between two bearing surfaces. The locking cam also includes a fairly long projection adapted to engage a pin on a drawer as the drawer is pulled out. As a drawer is pulled out the pin of the drawer engages the projection causing the cam to rotate 90° with the increased displacement of the cam moving the bar on which the cam is rotated or the adjacent bar against which the cam is bearing to take up such predetermined limited distance. Once one cam has rotated and such limited distance is taken up, further movement of the bars and the associated cams is precluded locking all of the other drawers against being pulled out.

When the cam rotates 90° a hook on the cam is positioned to engage the drawer pin when the drawer is returned or closed. The hook ensures that the cam will return to its original position with the reduced displacement of the cam permitting the spring to return the bars to the original position through such limited distance. Then any other drawer may be pulled out with the associated cam closing up or taking up such limited distance in turn precluding all of the other drawers from being pulled out.

In one form of the invention the cams may be provided with a second hook which may serve to release and engage pins on flip-up doors for each cabinet drawer. In such form of the invention when the cabinet is locked all of the bars are moved in unison against the pressure of the spring both to lock the doors against opening and also to preclude any drawer from being withdrawn providing a double measure of security. In such form the bars are all moved against the pressure of the spring by a cam operated by the key lock. When the cabinet is unlocked with the key the compression of the spring is released so that the bars may move the limited distance against the pressure of the spring enabling only one drawer at a time to be pulled out.

In another embodiment the key lock moves a locking arm to create a physical stop or block to prevent all locking bars from moving against the pressure of the spring. In such embodiment the spring is not compressed when the cabinet is locked with the key. The physical stop precludes all bars from moving and any drawer from opening. Such embodiment may be used in a pedestal height file unit. In such pedestal type units which may be positioned beneath or in association with work surfaces, the upper drawer may be a shallow tray adapted to contain office supplies such as pencils. Such tray may include a camp ramp adapted to engage an interlock pin projecting from the associated locking bar. In this manner the top tray may be pulled out at any time the cabinet is unlocked with the key elevating its associated bar such predetermined distance, but only one of the cabinet drawers therebelow may be pulled out at a time.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 3 is a similar schematic illustration showing the drawer pulled out with the associated locking cam pivoted 90° separating the locking bars the predetermined distance to preclude the other drawers from being pulled out;

FIG. 5 is an enlarged side elevation partially broken away and in section of the key operated cam for locking the cabinet;

FIG. 6 is an end elevation of such cam as seen from the line 6—6 of FIG. 5;

FIG. 7 is a diametral section of the key driven pinion for rotating such cam 90°;

DETAILED DESCRIPTION OF THE PREFERRED EMBODIMENTS

Figure 1:
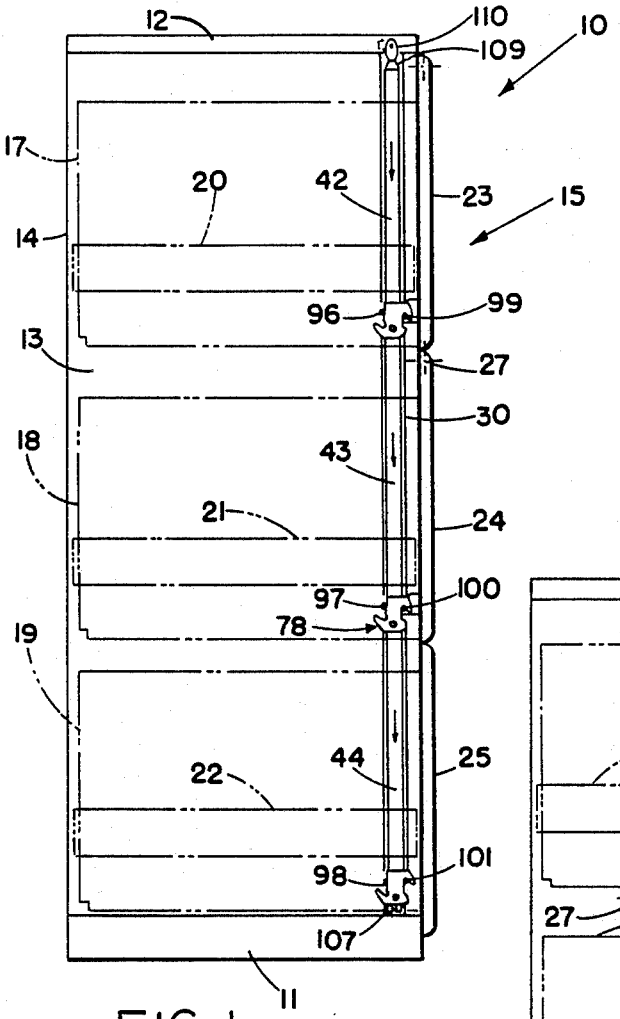
FIG. 1 is schematic side elevation of a full height file cabinet in accordance with the present invention illustrating the drawers and flip-up doors for each in the key locked condition.
Figure 2:
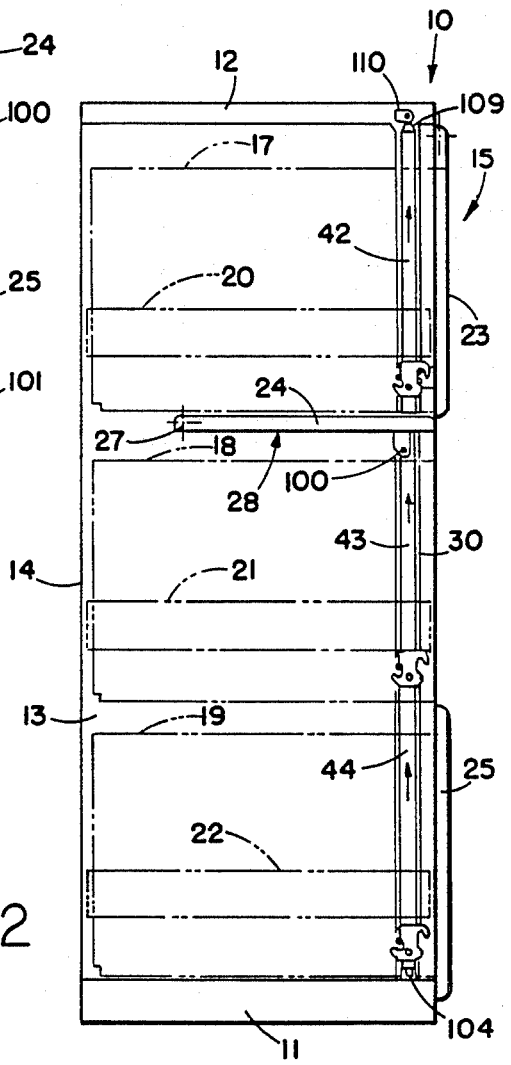
FIG. 2 is a similar schematic illustration illustrating the cabinet unlocked and the door of one drawer opened to its flip-up position.

Referring first to FIGS. 1–3 there is illustrated generally a typical three high lateral file cabinet in accordance with the present invention shown generally at 10. The cabinet includes a base 11 and a top 12. The cabinet also includes side walls 13, a back 14 and a front shown generally at 15.

Within the cabinet there is illustrated three lateral file drawers seen at 17, 18 and 19 which are mounted on conventional drawer slides 20, 21 and 22, respectively. At the front of the cabinet each drawer is provided with a flip-up door as seen at 23, 24 and 25, respectively.

As seen in FIGS. 2 and 3, in order to open the drawer 18, for example, the flip-up door 24 is pivoted upwardly about its top pivot 27 and is then slid rearwardly into the cabinet to the recessed horizontal position 28 seen in FIGS. 2 and 3. Then the drawer 18 may be pulled out.

Figure 4:
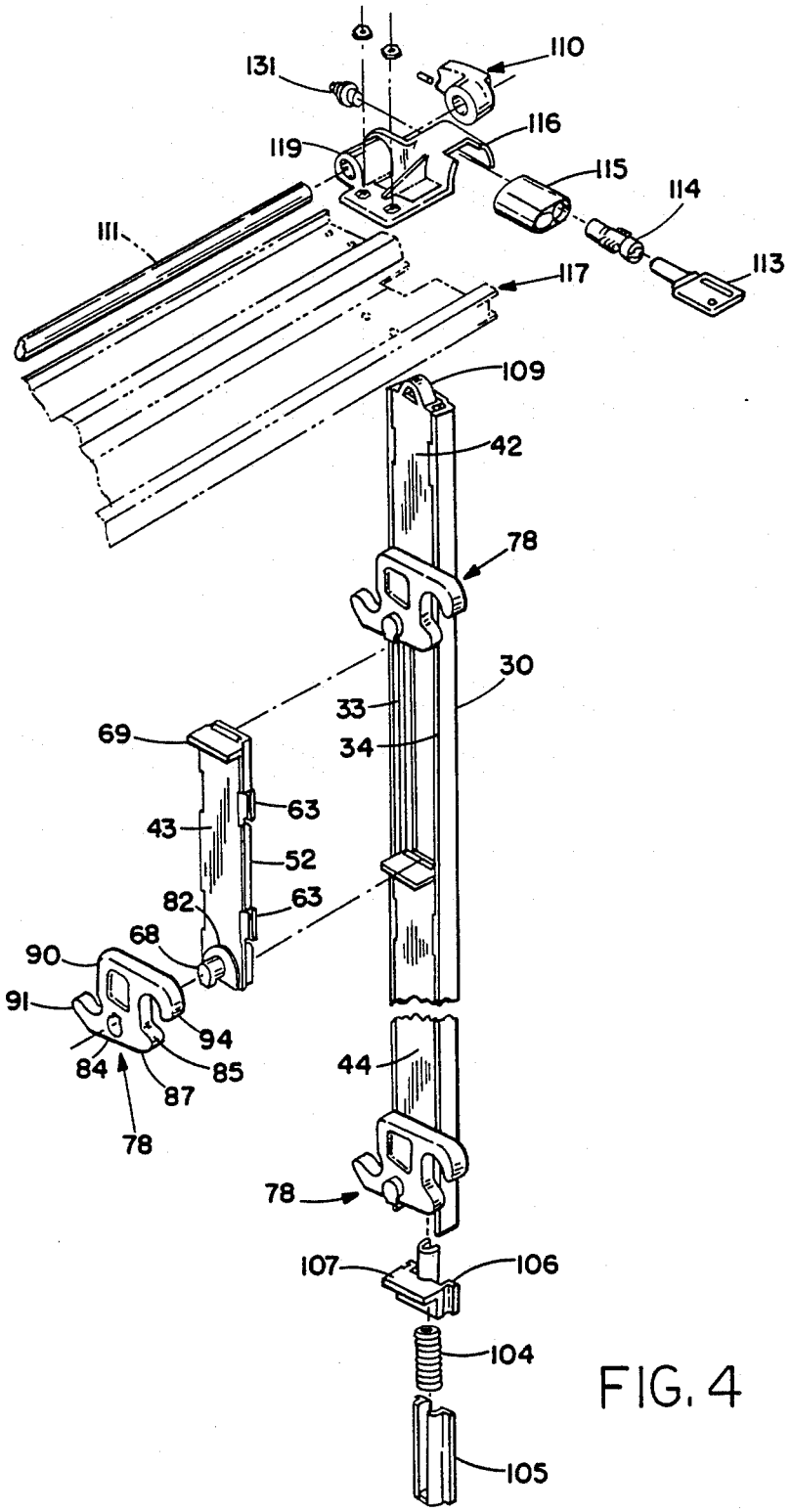
FIG. 4 is an enlarged exploded view of the key lock, track, locking bars and locking cams at one side of the cabinet.
Figure 9:
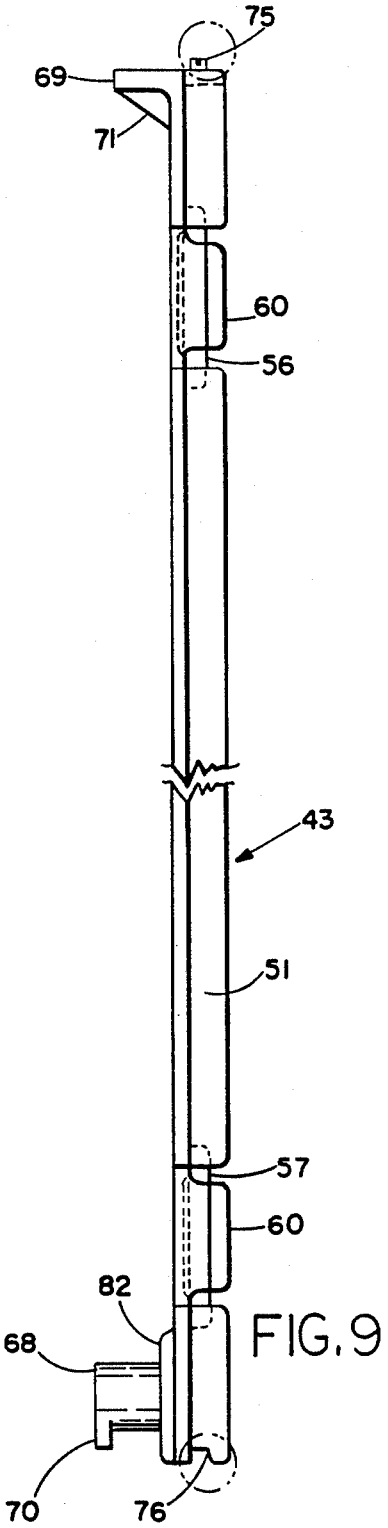
FIG. 9 is a side elevation of such locking bar.
Figure 8:
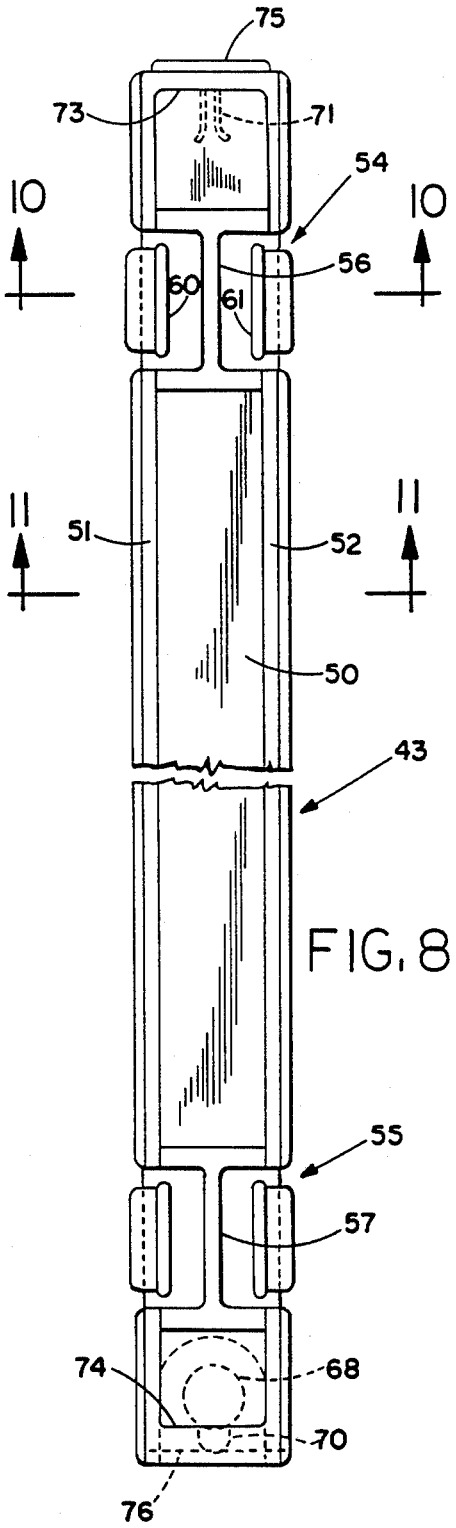
FIG. 8 is an enlarged elevation of a locking bar in accordance with the present invention.
Figures 10, 11, 12, 16, 17:
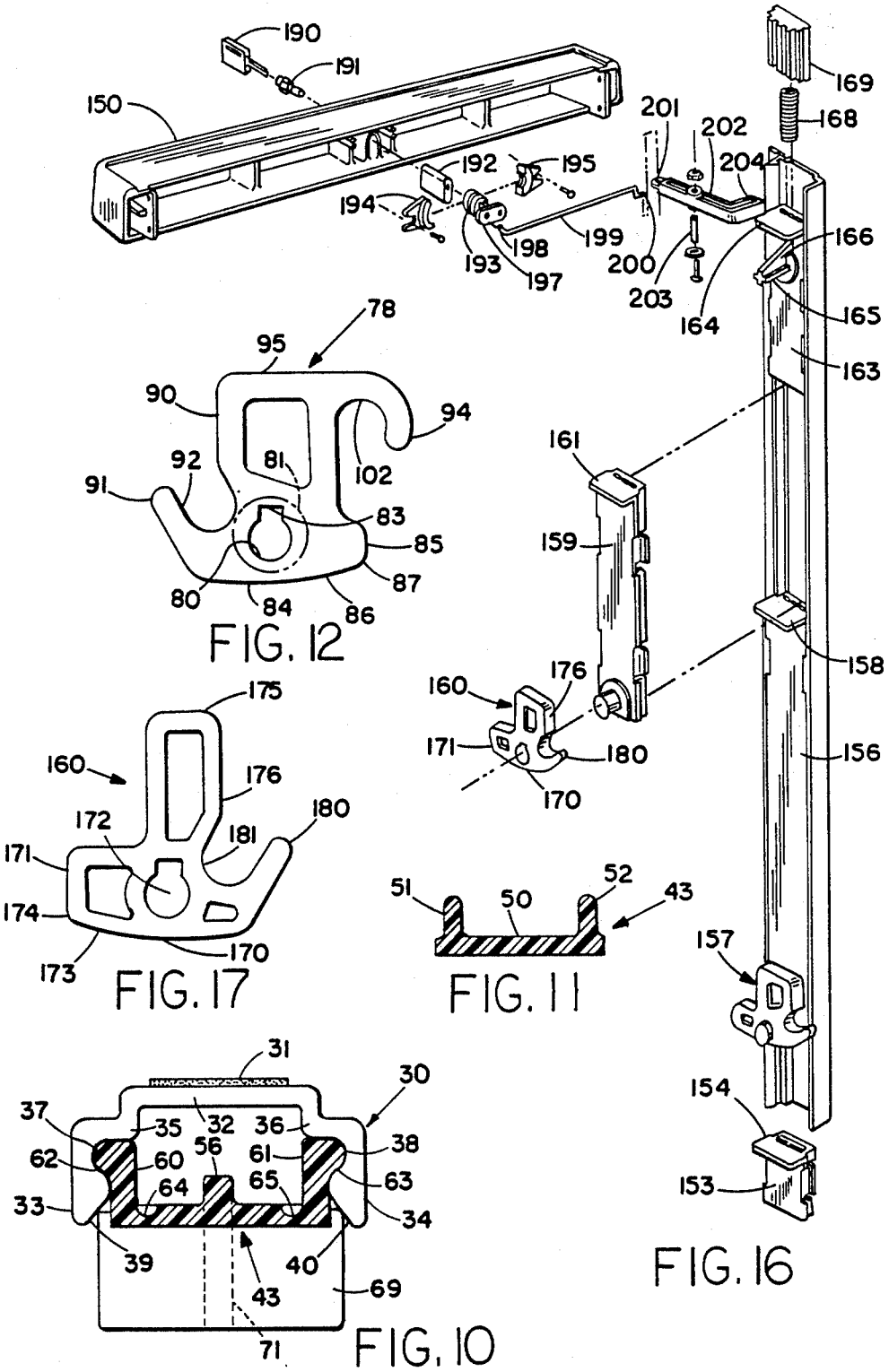
FIG. 10 is an enlarged horizontal section of the locking bar taken from the line 10—10 of FIG. 8 and illustrating the locking bar fitted within the track.
FIG. 11 is a horizontal section of the locking bar taken from the line 11—11 of FIG. 8.
FIG. 12 is an elevation of the locking cam used with the embodiment of the invention seen in FIGS. 1–11.
FIG. 16 is an enlarged exploded view of the key lock, track, locking bars and locking cams at one side of the pedestal unit cabinet.
FIG. 17 is an enlarged elevation of the locking cam used with the embodiment of the invention seen in FIGS. 13–17.

Referring now additionally to FIGS. 4, 10 and 11, positioned vertically at each side of the cabinet near the front is a vertical track 30. The vertical track may be secured to the interior of the exterior side wall of the cabinet as indicated by the double sided adhesive tape 31 in FIG. 10. The track is generally channel-shape and includes a back 32 and two legs 33 and 34 which extend from the back through the rebent offsets indicated at 35 and 36, respectively. The interior of each leg at the offset is provided with a laterally directed semi-circular channel as seen at 37 and 38 with the interior of the legs outwardly of such channel being tapered as indicated at 39 and 40, respectively. The semi-circular channels adjacent the offsets provide a vertical guide track for a plurality of vertically extending locking bars seen at 42, 43 and 44, there being one locking bar for each pull-out drawer. Such locking bars may be height coextensive with such drawers. If the drawers vary in height, so may the locking bars.

Referring now to FIGS. 8–11 it will be seen that each vertically extending locking bar is generally channel-shape and includes a web 50 and two edge flanges 51 and 52. The edge flanges extend throughout the major height of the locking bar except for two portions seen at 54 and 55 near the ends of the bar and through such portions the edge flanges merge into a single somewhat more shallow center rib seen at 56 and 57. At such portions, the locking bar is provided with two relatively short legs seen at 60 and 61 which include semicircular lateral projections 62 and 63 adapted to fit within the semi-circular channels 37 and 38 of the track. The locking bar interiorly adjacent the legs 60 and 61 may be undercut as indicated at 64 and 65 in FIG. 10. Such undercuts provide a degree of flexibility to the legs 60 and 61 so that the legs may be snapped into the track, camming over the ramps 39 and 40.

On the side opposite the track engaging legs each locking bar is provided at its lower end with a circular stud 68 and at its upper end with a projecting shelf 69, except for the top bar 42. The stud 68 at its outer end includes a downwardly projecting tab 70. The shelf 69 may be reinforced with a gusset 71.

The longitudinal flanges of each locking bar extend across the top and bottom as seen at 73 and 74 and the upper end of the locking bar, again excepting the top bar, may be provided with a slightly projecting transverse tongue 75 which is adapted to fit within a similarly configured transverse groove in the bottom of the locking bar indicated at 76. In this manner the tongue and groove illustrated assist in maintaining the locking bars in vertical alignment within the track.

Each stud 68 is adapted to receive a locking cam 78 shown in greater detail in FIG. 12. Each locking cam includes a circular aperture 80 surrounded by a slightly elevated interior face 81 which is designed to bear against the slightly elevated exterior face 82 surrounding the stud 68 on the locking bar. The circular hole 80 includes an upwardly extending radial slot or keyway 83 which is adapted to clear the downwardly projecting tab 70 on the stud. Thus the locking cam may be assembled on the stud upside down and then rotated to its upright position seen in FIGS. 4 and 12. In such upright position the tab maintains the locking cam on the stud.

The locking cam includes two alternate bearing surfaces seen at 84 and 85 which are 90° apart when measured from the center of the hole 80 or the stud 68. The radial difference between the bearing surfaces is the displacement of the cam. From the shorter displacement bearing surface 84 to the larger displacement surface 85 the cam includes an inclined ramp 86 and a fairly sharp yet radiused corner 87.

The cam also includes a fairly long normally vertically extending projecting surface 90 which is adapted to engage a drawer pin as hereinafter described. Associated with the projecting surface 90 is a hook finger 91 which is substantially radially spaced from the surface 90 and which includes an interior or bight portion 92 which extends inwardly from the surface 90 at an obtuse angle.

The locking cam 78 includes a second hook finger 94 which extends in curved fashion from the front of the upper end of the projection 95 which includes the projecting surface 90.

Referring again to FIGS. 1–3 it will be seen that each drawer 17, 18 and 19 is provided with a laterally projecting drawer pin seen at 96, 97 and 98 which, when the drawer is closed, is positioned immediately behind the vertically projecting surface 90 of each interlock cam. Also, each flip-up door 23, 24 and 25 is provided with a laterally projecting interior pin seen at 99, 100 and 101 which is designed to be engaged by the hook finger 94. When the cabinet is locked, as hereinafter described, each door pin fits within the circular bight portion 102 of the hook finger 94.

Referring again to FIG. 4 at the bottom of the track 30 there is provided a compression spring 104 which may be situated in spring retainer 105 which bears against slider 106 provided with shelf 107. The shelf bears against the appropriate bearing surface of the interlock cam 78 of the lowermost locking bar 44 and urges all of the locking bars upwardly within the track 30. The shelf 107 may overlie and engage the base or other fixed stop in the cabinet when the locking bars are urged downwardly.

The uppermost locking bar 42 instead of being provided with a shelf includes a top triangular projection 109 which bears against lock cam 110 mounted for rotation on the end of transverse lock shaft 111. The lock cam 110 is rotated 90° by the key 113 which fits within lock core 114 which in turn fits within barrel 115, both fitting in bracket 116 secured to the top transverse frame member 17. The bracket 116 includes a boss 119 accommodating the transverse shaft 111. The lock cam fits on the projecting end of the shaft opposite the viewer in FIG. 4. The shaft may have a lock cam on its end toward the viewer engaging an interlock mechanism which is a mirror image of that illustrated in FIG. 4. In this manner the drawers and doors are locked on both sides.

As seen more clearly in FIGS. 5 and 6 the lock cam includes a hub 121 adapted to receive the end of shaft 111. The shaft may be provided with a flat as is the recess 122 in the hub and the shaft may be secured in place by a set screw or other suitable fastener extending through the tapped hole 123.

The lock cam includes a radial arm 125 which includes a narrow tip 126 which in turn includes a socket or recess 127. The recess in the tip of the lock cam is designed to mate with the tip of the triangular portion 109 on the top locking bar 42.

The lock cam on the side opposite the hub 121 includes bevel gearing indicated at 129 which extends slightly beyond 90° of the outside face of the lock cam. Such bevel gearing is in mesh with the bevel gearing 130 of lock pinion 131 which is driven for rotation by the core 114 and, of course, key 113. Lock cam 110, like the locking cams 78, has two bearing surfaces indicated at 133 and 134 which are 90° apart. The displacement of the lock cam is substantially the same as the displacement of the locking cams, which is such limited distance.

Referring now to FIG. 1, the cabinet is illustrated in its locked condition. The rotation of key 113 has positioned the tip of the lock cam 110 at the top of the cabinet in the down position and this in turn has forced the combination of locking bars downwardly compressing the spring 104 at the bottom of the cabinet. With the spring compressed the entire stack of lock bars and the associated cams are moved downwardly the predetermined limited distance through which the spring is deflected. Such downward movement causes the lock fingers 94 of each cam of engage the lock pins on the flip-up doors and thus the doors are unable to swing open or to the right as seen in FIG. 1. Also, the pull-out drawers are unable to be pulled out because the projecting surfaces 90 of each cam interfere with the drawer pins 96, 97 and 98. Since the cams are unable to rotate when the spring is deflected both the drawers and locks are locked.

As seen in FIG. 2 the cabinet has now been unlocked by the key and the lock cam 110 at the top of the cabinet has been positioned horizontally with the triangular tip 109 of the top lock bar now bearing against the bearing position 133 of such lock cam. This has allowed the spring 104 at the bottom of the cabinet to elevate the stack or combination of locking bars upwardly. Because of the elevation of the locking bars and the associated locking cams, each of the flip-up doors can now be swung open since the door pin is now vertically clear of the downwardly projecting hook finger 94 of each locking cam. As illustrated, the door 24 of the middle drawer has been swung open and elevated to its upper horizontal recessed position 28. The drawer 18 may now be pulled out of the cabinet.

As seen in FIG. 3, the drawer 18 has now been rolled out of the cabinet and in so doing has rotated the interlock cam 78 90°. This has been caused by the engagement of the drawer pin 97 with the projection 90 of such interlock cam causing the cam to rotate 90° so that the bearing surface 85 of the locking cam is now bearing against the shelf of the locking bar 44. The displacement of the cam 78 has forced the locking bars below the rolled out drawer downwardly compressing the spring 104. Because the spring deflection is limited to the displacement of one interlock cam the remaining drawers are prevented from extending. In this manner such limited distance has been taken up thereby blocking all other locking bars and the respective cams from movement thus keeping all other drawers from being pulled out.

When the drawer 18 is returned, the hook finger 91 is now positioned to catch the drawer pin 97 and as the drawer is returned to its closed position, the cam oscillates back 90° permitting the spring to return to its undeflected condition thus enabling any other drawer to be pulled out. The other drawers cannot be pulled out until the displaced locking cam returns to its original position. When all of the drawers are in and the doors down, the key may again be employed to rotate the lock cam to its down or locked position compressing the spring to lock the doors shut and the drawers in.

Referring now to the embodiment of the invention disclosed in FIGS. 13–17, it will be seen that the office cabinet 140 illustrated is in the form of a pedestal or credenza type filing unit. Such pedestal units are normally approximately work surface height and are often used in connection with work surfaces. The unit 140 includes a back 141 and a base 142. The top is indicated at 143 and the front is seen on the right in FIGS. 13, 14 and 15 as indicated at 144.

The unit may include two drawers 146 and 147 which may vary in height and the unit also includes a top relatively shallow convenience tray 148 which functions much as a desk center drawer in which pencils and other office odds and ends are normally stored. The front of the cabinet may include a top molding 150 in the center of which is a lock for the cabinet.

At one side of the cabinet there is provided a vertical track near the front of the cabinet as indicated at 152. Such vertical track may extend the full height of the cabinet and as seen in FIG. 16 at the bottom includes a fixed bar 153 which includes an inwardly projecting shelf 154 on the top thereof. The bar 153 fits within the track 152 in the same manner as the other bars hereinafter described which may be in the same manner as the bars previously described. Positioned above the bar 153 is a locking bar 156 which is provided with a locking cam 157 pivoted to the bottom interior thereof. The locking bar 156 is provided with a shelf on the upper end as seen at 158. Positioned above the locking bar 156 is a locking bar 159 which includes a locking cam 160 pivoted to the lower end thereof and a shelf projecting from the inner upper end as indicated at 161. The locking bars 156 and 159 as illustrated vary in height and such height corresponds to the difference in height of the drawers 147 and 146, respectively.

Positioned above the locking bar 159 is a further locking bar 163 for the convenience tray which includes at the top thereof a shelf 164. Immediately below the shelf 164 the locking bar 163 is provided with an inwardly directed cross-shape pin or follower 165. The follower is rigidified by a triangular gusset 166. Positioned above the shelf 164 is a compression spring 168 held in place by a fixed spring retainer 169.

The locking bars in the pedestal unit embodiment may be of the same configuration and construction as those previously described in connection with the full height cabinet embodiment and such locking bars slide within the track 152 and are stacked on top of each other for limited distance movement within such track. The locking bars 159 and 156 include pivoted to the lower end thereof the locking cams 160 and 157, respectively, which are shown in greater detail in FIG. 17.

Referring now to FIG. 17 it will be seen that the locking cam 160 includes a bearing portion 170 and a radially displaced bearing portion 171 90° from the center 172 of the pivot. The cam surface between such bearing portions includes a ramp or slope 173 and a fairly sharp radiused corner 174. Projecting oppositely from the bearing surface 170 is a projection 175 which includes a projecting interference surface 176 which is adapted to engage drawer pin 178 seen in FIGS. 13–15. Drawer pin 179 for drawer 147 engages the interlock cam 157. Positioned adjacent the projecting surface 176 is the hook finger 180 with the bight portion of the hook extending at an obtuse angle with respect to the projecting surface 176. Since the cabinet has no flip-up doors, a second hook need not be provided. The interlock cams 160 and 157 cooperate with the drawer pins 178 and 179 in the same manner as in the full height cabinet embodiment.

Figure 14:
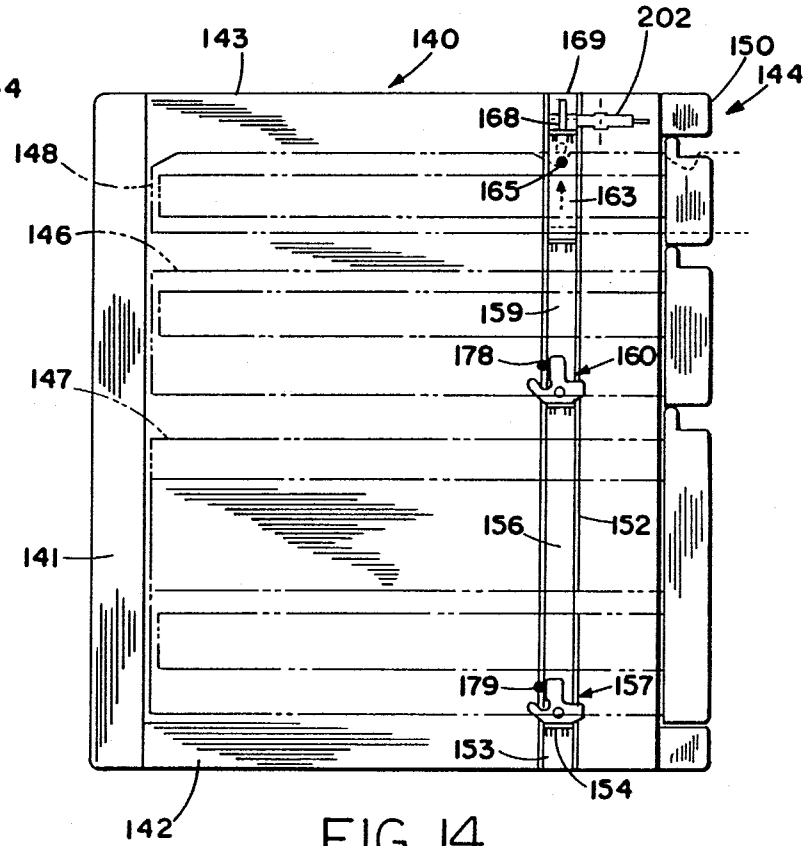
FIG. 14 is a schematic side elevation of such pedestal unit illustrating the cabinet unlocked.
Figure 13:
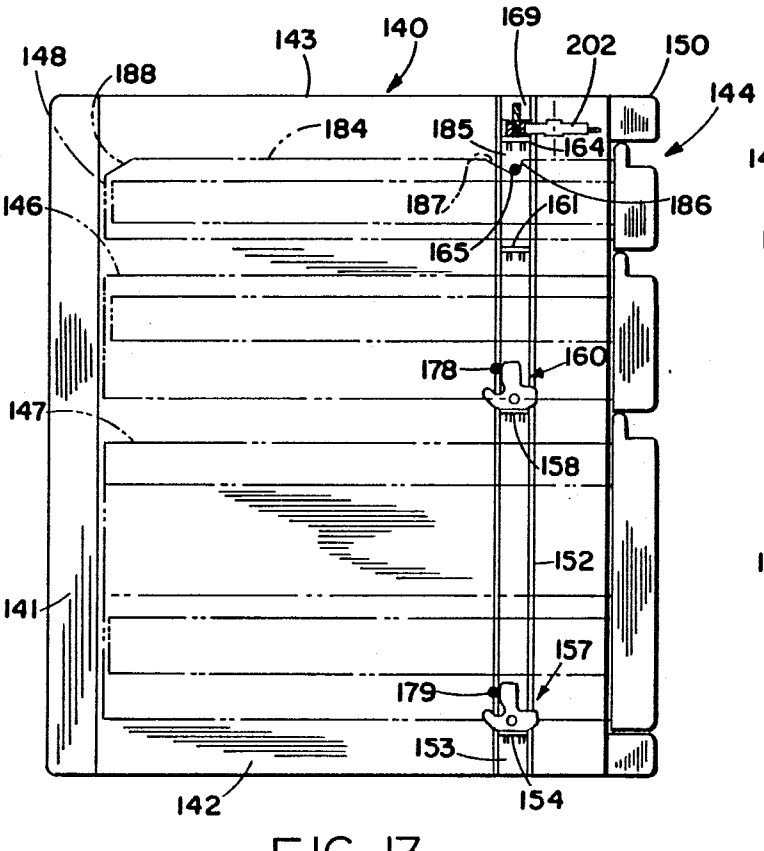
FIG. 13 is a schematic side elevation of a pedestal type file unit in accordance with the present invention illustrating the cabinet locked.
Figure 15:
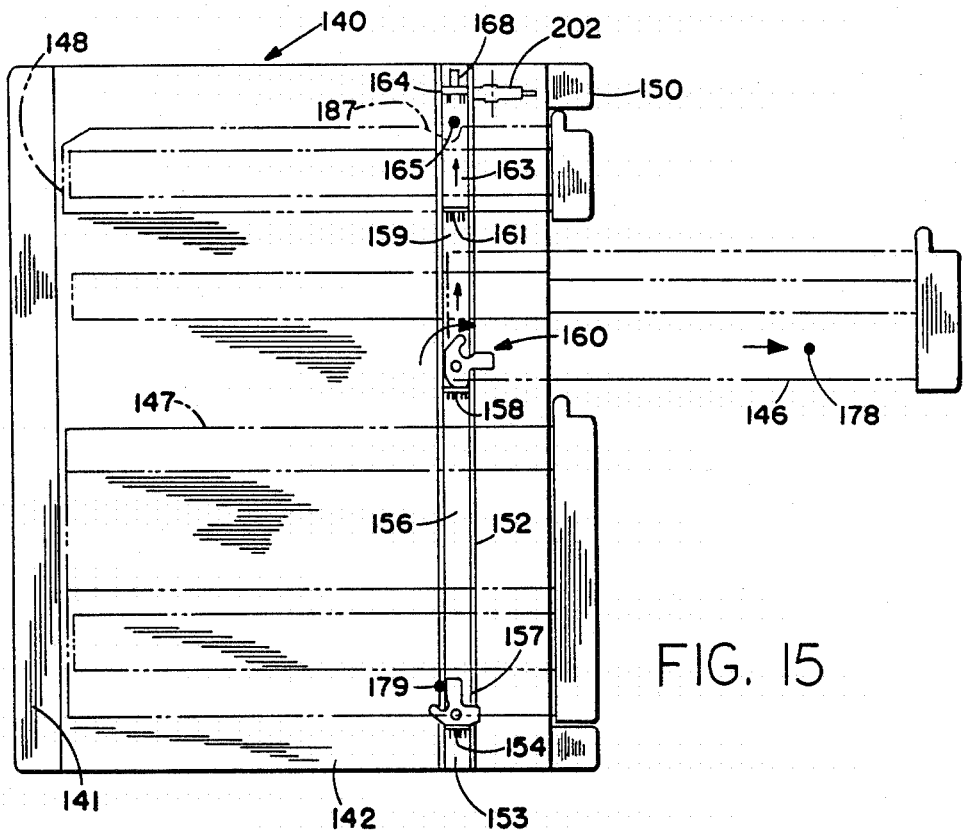
FIG. 15 is a similar schematic side elevation of the pedestal unit illustrating one of the drawers extended.

The inwardly projecting pin or projection 165 on the top locking bar 163 cooperates with a cam ramp seen at 184 in FIGS. 13–15 which is on the top of the convenience tray 148. Such cam ramp includes a notch 185 which includes a shoulder 186 on the front side and an inclined ramp 187 on the rear side. There also may be a ramp 188 at the rear of the tray as illustrated to facilitate insertion of the tray. When the tray 148 is fully inserted, the projecting pin 165 fits within the notch 185.

With reference to FIG. 16 it will be seen that the cabinet may be locked by key 190 turning core 191 in barrel 192. The key, when inserted, rotates element 193 90°, such element being journaled in half hubs 194 and 195 secured to the rear of molding 150. The element 193 includes a diametral arm 197 with holes at each end. The bent end 198 of rod link 199 projects through one of the holes, the opposite end of the rod link being bent as indicated at 200 to fit through hole 201 at the inner end of locking arm 202. The locking arm is pivoted for horizontal swinging movement on shaft 203 and includes an offset end 204. In the locked condition of the cabinet the arm offset end 204 is inserted between shelf 164 of the top locking bar 163 and the bottom of spring retainer 169. This prevents the locking bars below from moving upwardly and the spring from being compressed. When the cabinet is unlocked, the offset end 204 is clear of the shelf 164.

Although in this embodiment the interlock mechanism is illustrated on one side of the cabinet only, it will be appreciated that a mirror image of the interlock mechanism may be provided on the opposite side, both being locked from the central key lock in the top molding 150.

Referring first to FIG. 13 the pedestal cabinet is shown locked. The rotation of the key 190 has pivoted the locking arm 202 into the space between the interlock spring retainer 169 and the top of the interlocking bar 163. This effectively blocks any locking bar from moving upwardly. Such blocking of movement also prevents the interlock cams 160 and 157 from rotating. In such locked condition both drawers 146 and 147 are locked because the interlocking cams are not able to rotate. Also, the top tray is locked in position because the pin 165 projecting from the top locking bar cannot move up.

As seen in FIG. 14 the cabinet has now been unlocked. This has been accomplished simply by key rotation which has pivoted the locking arm 202 out of the interlock channel freeing the locking bars to move upwardly. The space at the top of the interlock system is now open permitting interlock cam rotation or movement of the pin 165 up the ramp 187.

As seen in FIG. 15, the drawer 146 has been pulled out and the drawer pin 178 has engaged and rotated the interlock cam 160 90°. The displacement of the cam 160 has taken up the limited movement available to the locking bars. This has forced the combination of locking bars above the rolled out drawer upwardly compressing the spring 168. Because the spring deflection is limited to the displacement of one interlock cam, or the tray ramp displacement, the remaining drawer is prevented from extending. However, it is noted that the top convenience try may nonetheless be pulled out or pushed back without affecting the interlock system. When the tray is pulled out alone, the spring is compressed by elevating the top bar. This permits one of the two drawers below to be pulled out, but not both.

Essentially all of the parts may be fabricated from rigid plastic materials having a low coefficient of friction so that the parts will work smoothly and quietly.

It can now be seen that there is provided a simplified and efficient lock and interlock system for office cabinets.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A filing cabinet including an interlock mechanism, said cabinet comprising a plurality of horizontally movable drawers, means in said cabinet for supporting said drawers for horizontal movement into and out of said cabinet, a vertical said cabinets at the side of said drawers, a plurality of spring loaded stacked locking bars, one for each drawer, mounted for vertical movement in said track, each locking bar having a shelf projecting laterally from one longitudinal end, means for limiting the vertical movement of said stacked locking bars, an interlock cam pivotally mounted on the other longitudinal end of each locking bar for oscillation through 90°, each interlock cam having first and second radially spaced bearing surfaces, each bearing on the shelf of the adjacent locking bar on the first bearing surface of the cam, each cam having a pair of transition surfaces in series between the bearing surfaces, one of the transition surfaces forming a gently inclined ramp and the other being more sharply curved, a pin on each drawer positioned to engage the respective interlock cam and pivot the same through 90° when a drawer is pulled out, the pivoting of the interlock cam causing the two transition surfaces of the cam to roll and slide sequentially across the shelf of the locking bar and causing the second bearing surface to contact the shelf to cause relative movement in the track between the locking bars to close up the limited distance so that none of the locking bars can then move whereby each other interlock cam is prevented from pivoting, locking all other drawers in the closed position.

2. A filing cabinet as set forth in claim 1 including a compression spring returning said locking bars such limited distance when said interlock cam is returned to its original position.

3. The filing cabinet of claim 2 including key lock means for moving said locking bars through said limited distance against the bias of said spring thereby to lock all said drawers in the closed position, said key lock means including a tumbler assembly rotatable about a first axis and a key lock cam rotatable about an axis transverse to the axis of the tumbler assembly, said key lock cam being operative in the locking position to engage said locking bars and compress said spring.

4. A filing cabinet as set forth in claim 3 wherein said key lock cam has a displacement approximately equal to such limited distance.

5. A filing cabinet as set forth in claim 4 wherein said key lock cam is at the top of said track, and the compression spring is at the bottom.

6. A filing cabinet as set forth in claim 5 including a follower projection on top of said uppermost locking bar in engagement with said key lock cam.

7. The filing cabinet of claim 3 including bevel gears for transmitting rotary motion from said tumbler assembly to said key lock cam.

8. A filing cabinet as set forth in claim 1 including a convenience tray at the top of said cabinet, a cam ramp on said tray, a locking bar for said tray including a pin engaging said cam ramp to elevate said locking bar such predetermined distance thereby permitting a selected one of the drawers below the convenience tray to be pulled out.

9. A cabinet as set forth in claim 1 wherein each interlock cam includes a displacement equal to such limited movement.

10. A cabinet as set forth in claim 9 wherein the two bearing surfaces of each interlock cam are 90° apart, the radial distance to such bearing surfaces forming such displacement.

11. The cabinet of claim 1 wherein said vertical track has walls defining a generally U-shape cross section, said walls defining an opposed pair of semicircular channels, and said locking bars having a pair of legs spaced to fit between the walls of the track, each of the legs having a semicircular lateral projection contoured to fit in a corresponding semicircular channel in the track walls.

12. The cabinet of claim 11 wherein said locking bars have a generally planar back member from which the legs extend in parallel, the planar back member being relieved where each of the legs joins said planar back member thereby to enhance flexure of said legs.

13. The cabinet of claim 12 wherein the walls of the track have distal portions defining opposed inwardly tapering camming surfaces, the projections of the locking bars following the contour of the camming surfaces and the connections between the legs and planar back member flexing as the locking bar is inserted into the track.

14. The cabinet of claim 13 wherein each locking bar includes two pair of legs vertically spaced from each other.

15. The cabinet of claim 13 wherein the track is secured to the inside of the cabinet by an adhesive tape system.

16. The cabinet of claim 1 wherein each of said interlock cams includes a pair of drive surfaces positioned to be contacted by said pin, said drive surfaces being planar, including between them an acute angle, and being connected by an arcuate pin-receiving bight.

* * * * *